United States Patent [19]

Chertok

[11] 4,162,651

[45] Jul. 31, 1979

[54] DOCUMENT PRINTER

[75] Inventor: Allan Chertok, Bedford, Mass.

[73] Assignee: Concord Computing Corporation, Bedford, Mass.

[21] Appl. No.: 680,062

[22] Filed: Apr. 26, 1976

[51] Int. Cl.[2] ..... B41F 1/00

[52] U.S. Cl. ..... 101/287; 101/316; 101/93.05

[58] Field of Search ..... 101/93.04, 93.05, 93.41, 101/232–235, 245, 287, 316–317, 322; 197/1 R, 127 R, 138

[56] References Cited

U.S. PATENT DOCUMENTS

| | | | |
|---|---|---|---|
| 3,119,328 | 1/1964 | Pittman et al. | 101/316 X |
| 3,389,658 | 6/1968 | Matthew | 101/287 |
| 3,718,244 | 2/1973 | Bukowski et al. | 197/127 R |
| 3,771,443 | 11/1973 | Georghallis | 101/233 X |
| 3,837,461 | 9/1974 | Waibel | 101/287 X |
| 3,912,068 | 10/1975 | Kwan et al. | 197/127 R |
| 3,923,135 | 12/1975 | Holman et al. | 197/1 R X |

*Primary Examiner*—Edward M. Coven
*Attorney, Agent, or Firm*—Kenway & Jenney

[57] ABSTRACT

Disclosed is a document printer of the type suitable for imprinting messages upon individual documents fed into the apparatus (e.g., bank checks). The apparatus includes an internal printing station disposed along a document feed path. The path includes a feed slot in an exterior wall of the apparatus. The printing station includes both impact printer means and document drive means, the latter operative to move the document along the document path positioning different parts of the document adjacent the impact printer means for the printing of multiple lines of information, where necessary. Both the impact printer means and the document drive means comprise first and second subunits which are positioned, respectively, on opposite sides of a document at the printing station. In particular, the drive means comprise upper and lower rollers, at least one of which is driven, which are engagable with opposite surfaces of the document. The impact printer means comprise an impact print head on one side of the document and a rigid platen on the other side. The platen and the upper driven roller are supported on a first frame above the document path, while the print head and the lower roller are supported on a second frame and positioned to engage the lower surface of a document on the feed path.

2 Claims, 6 Drawing Figures

DOCUMENT PRINTER

BACKGROUND OF THE INVENTION

The present invention relates to apparatus for imprinting single documents with various printed information. An example of this type of apparatus is a check imprinter that can endorse and otherwise imprint a check with a variety of information (e.g., endorsor, amount, date, etc.). Apparatus of this type must be relatively inexpensive and simple and rapid to operate in order to be well received in the market place.

In view of the foregoing discussion, it is a principal object of the present invention to provide apparatus of the type described that is both relatively inexpensive, and is convenient to operate.

SUMMARY OF THE INVENTION

Briefly, the invention features apparatus for printing a message on a document comprising a document feed path defined with respect to a rigid chassis and a printing station along said path. The printing station includes an impact printer and document drive means, each of which comprises first and second subunits positioned, respectively, above and below the document feed path. First and second frames, supported on said chassis, support said first subunits and said second subunits, respectively. The first frame is supported to a position its subunits below the document feed path. The second frame is movable between a first position in which its drive means subunit (e.g., a driven roller) is spaced apart from a document positioned on the feed path and a second position in which that drive means subunit engages the document. A drive system is provided for moving the second frame to its second position when a document is properly located for printing and for moving it to its first position after printing of the document has been completed.

BRIEF DESCRIPTION OF THE DRAWINGS

Other objects, features, and advantages of the invention will appear from the following description of a particular preferred embodiment, taken together with the accompanying drawings, in which.

DETAILED DESCRIPTION OF A PARTICULAR PREFERRED EMBODIMENT

Figure 1:
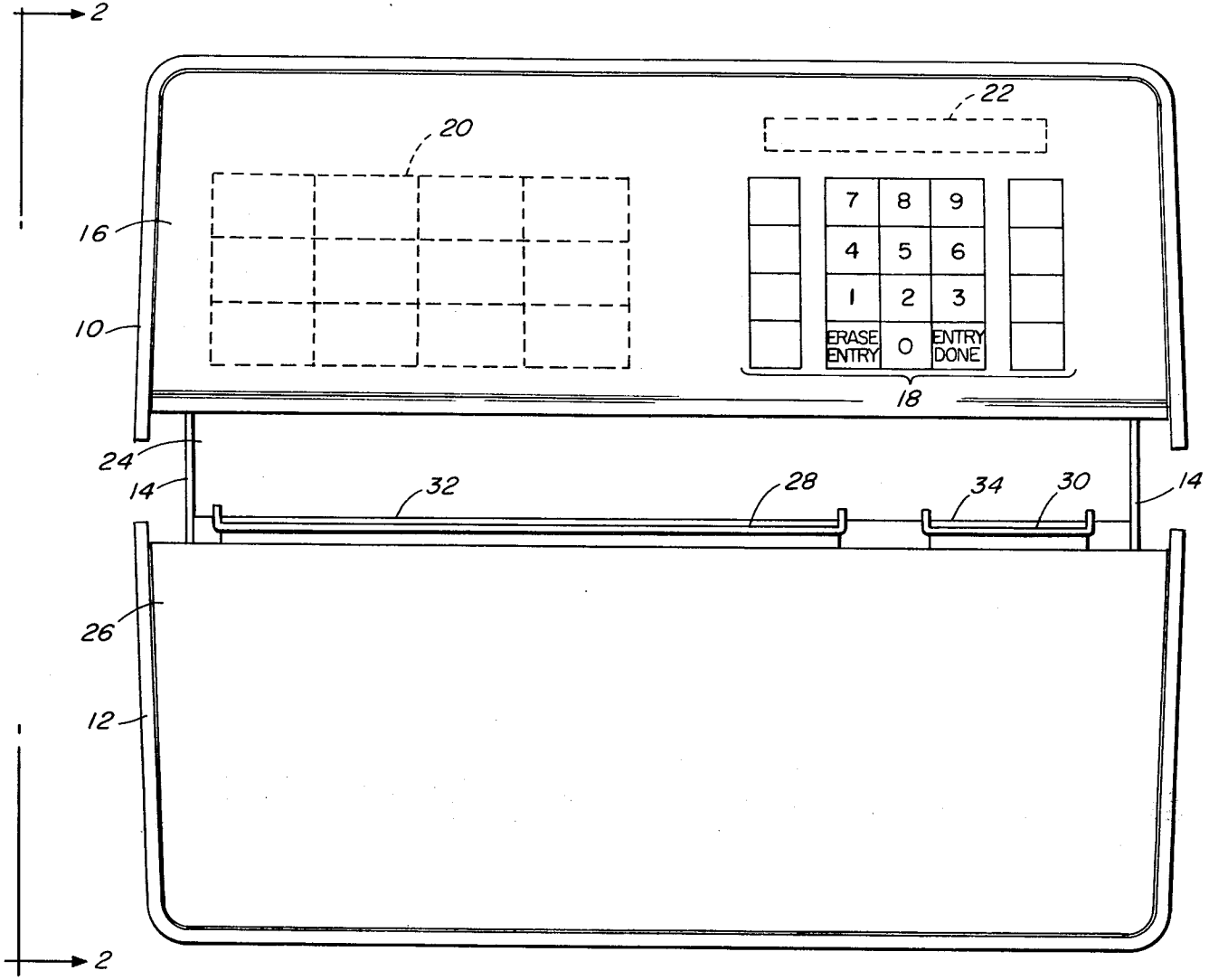
FIG. 1 is a front elevation of a financial transaction recording and verifying terminal which incorporates an internal document printer constructed in accordance with the present invention.

FIG. 1 is a front elevation of a data terminal suitable for a variety of functions involving financial transactions. Details of many of those functions, as well as the mechanical and electronic arrangements by which they are achieved, form no part of the present invention and are not described in detail herein. The terminal is illustrated only as exemplary of one environment in which a document printer incorporating features of the present invention is useful.

The terminal includes upper and lower housing members 10 and 12 and a frame 14 linking the housing members into a single unit. A number of push button type electrical contacts 18, which can be employed by a user of the terminal to select a function of the terminal desired, enter data, etc., protrude from the front panel 16 of the upper housing 10. Regions 20 and 22 on the front panel 16 are locations of visual displays presented to the user of the terminal for the purpose of giving instructions, indicating data already entered, etc.

The frame 14 supports a front panel 24 intermediate the front panel 16 of housing 10 and the front panel 26 of housing 12. A pair of tray-like receptacles 28, 30 project from the panel 24 and define the lower surfaces of thin slots 32, 34 in the face of panel 24. In the illustrated terminal, the tray 30 and slot 34 are designed to receive an item (e.g., a credit card) which supplies information to the terminal. These elements form no part of the present invention. On the other hand, the tray 28 and slot 32 are designed to receive a document, such as a check, to be endorsed by the terminal and to have certain other information imprinted thereon by the document printer according to the present invention, as described in detail below with reference to the other figures.

Figure 2:
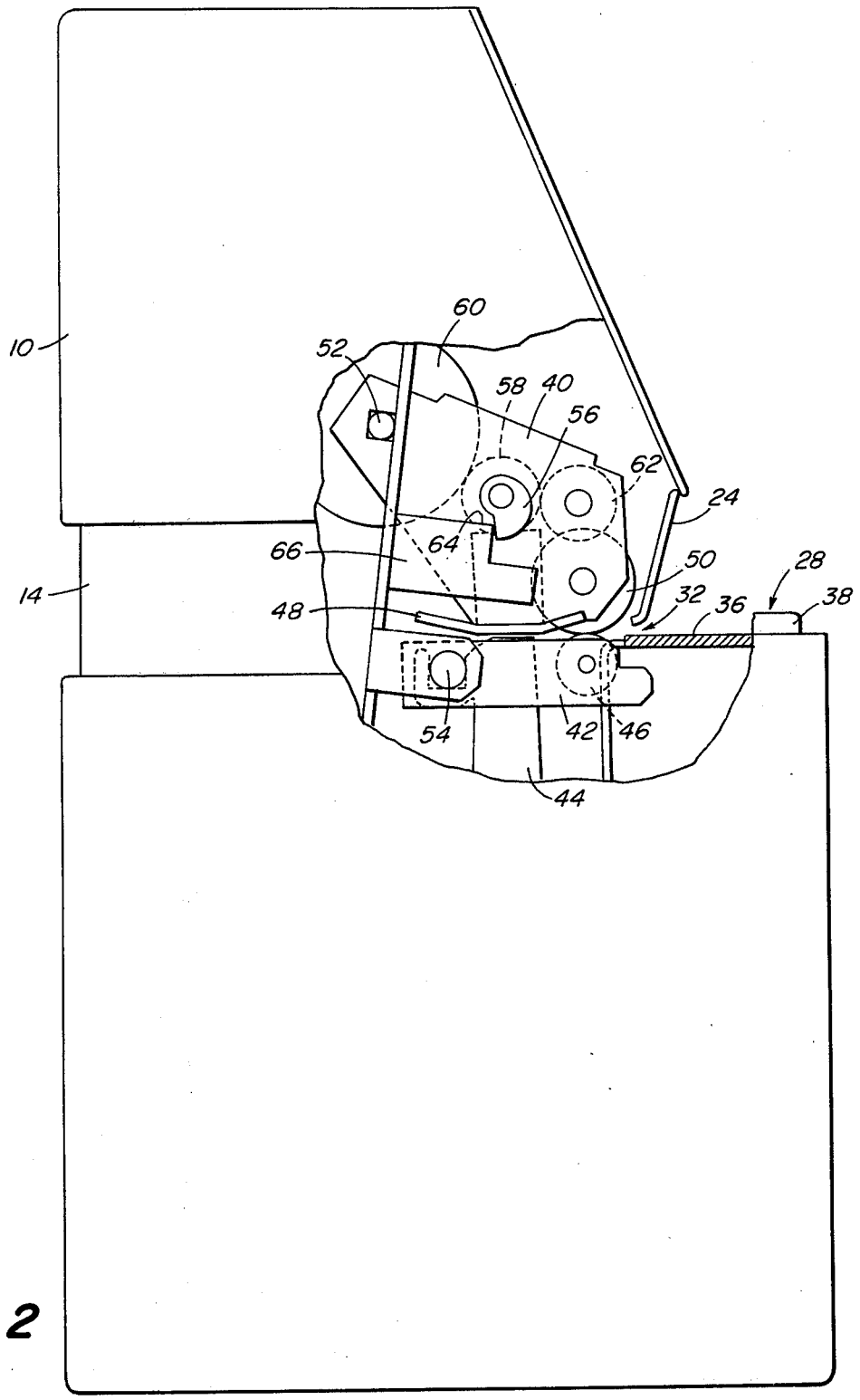
FIG. 2 is a vertical section taken at 2—2 of FIG. 1 illustrating the relationship of the document printer to other portions of the terminal.

Referring to FIG. 2, a side elevation of the document printer is shown in the broken-away portion of the figure. While the details of the document printer are more readily explained with reference to the enlarged views of FIGS. 3–5, the general arrangement of the major parts of the printer, and their relationship to the terminal in the particular environment illustrated, are apparent from FIG. 2.

The tray 28 comprises a horizontal member 36 and vertically disposed integral end plates 38. The upper surface of the horizontal member 36 forms a portion of a document feed path described in greater detail below with reference to FIGS. 3 and 4. Actual printing of the document occurs at a printing station along that feed path. The printing station incorporates impact printing means and document drive means, which cooperate to provide the capacity for imprinting the document with multiple lines (e.g., five lines) of printed information. An upper frame member 40 and a lower frame member 42 each support portions of each of the impact printer means and the drive means. In particular, the lower frame member 42 supports an impact printer head 44 and a lower roller 46, while the upper frame member 40 supports a platen 48 aligned with the impact printer head 44 and an upper roller 50 aligned with the roller 46 to form a drive means for the document. The upper frame 40 is supported for slight rotational motion about a pivot axis 52 and is biased in a clockwise direction by spring means 53. The lower frame member 42 is also supported for minor rotational motion about a pivot axis 54 and is biased in a counter-clockwise direction (as viewed in FIG. 2) by spring means described below with reference to FIGS. 5A-5B. Other major elements of the printing station include a cam 56 rotatably supported on the upper frame 40 and linked to a gear 58 that is disposed to be driven by a wheel 60 centered on the pivot axis 52 of the upper frame. A gear 62 links a gear 58 with the roller 50, whereby the roller 50 is driven simultaneously with the driving of the cam 56. The cam 56 rides upon the upper edge 64 of a fixed arm 66 that is rigidly secured to the chassis of the terminal.

Figure 3:
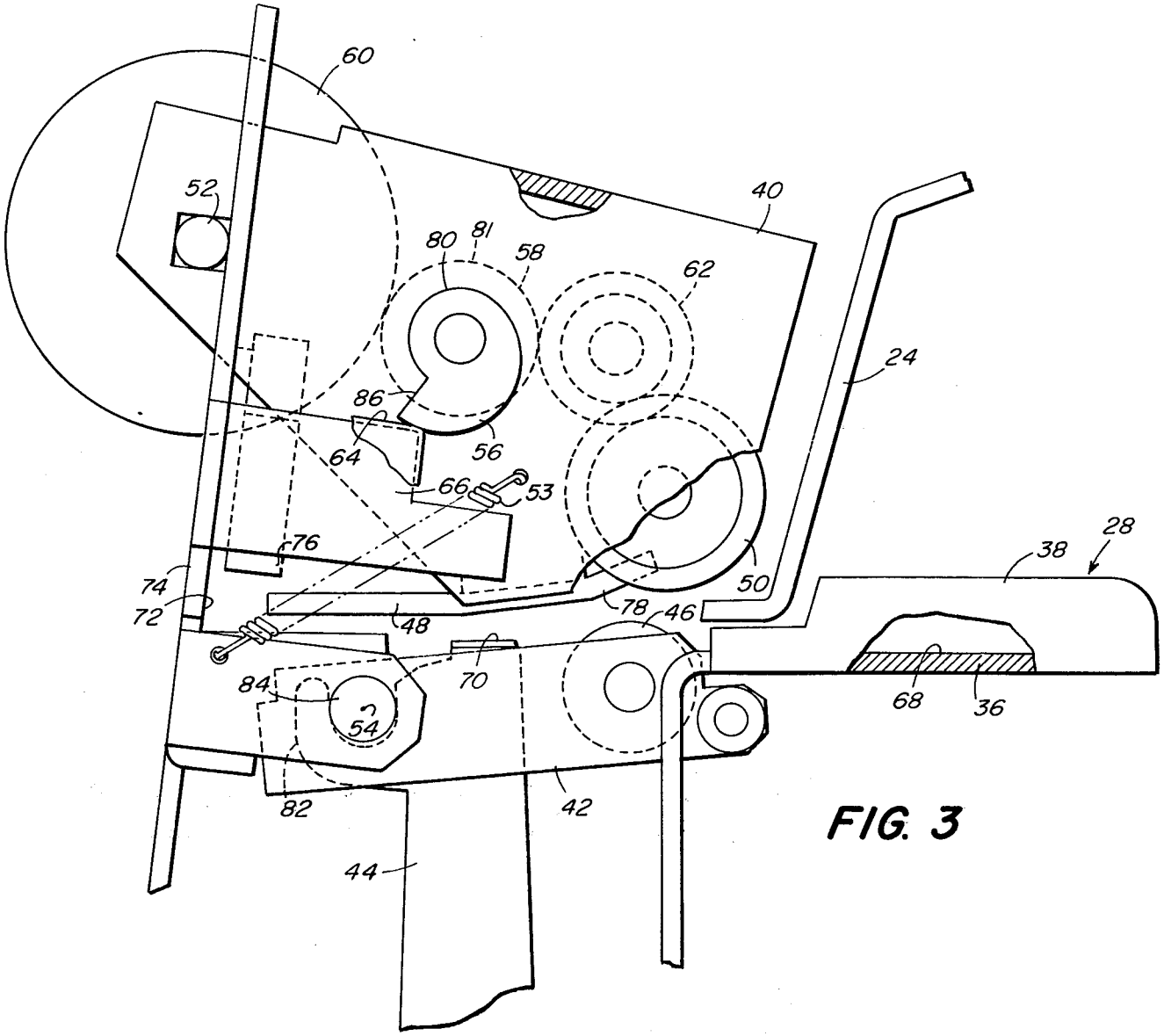
FIG. 3 is an enlarged, partially broken-away, side elevation of the document printer shown in FIG. 2, with the document printer in a condition suitable for receiving a document.
Figure 4:
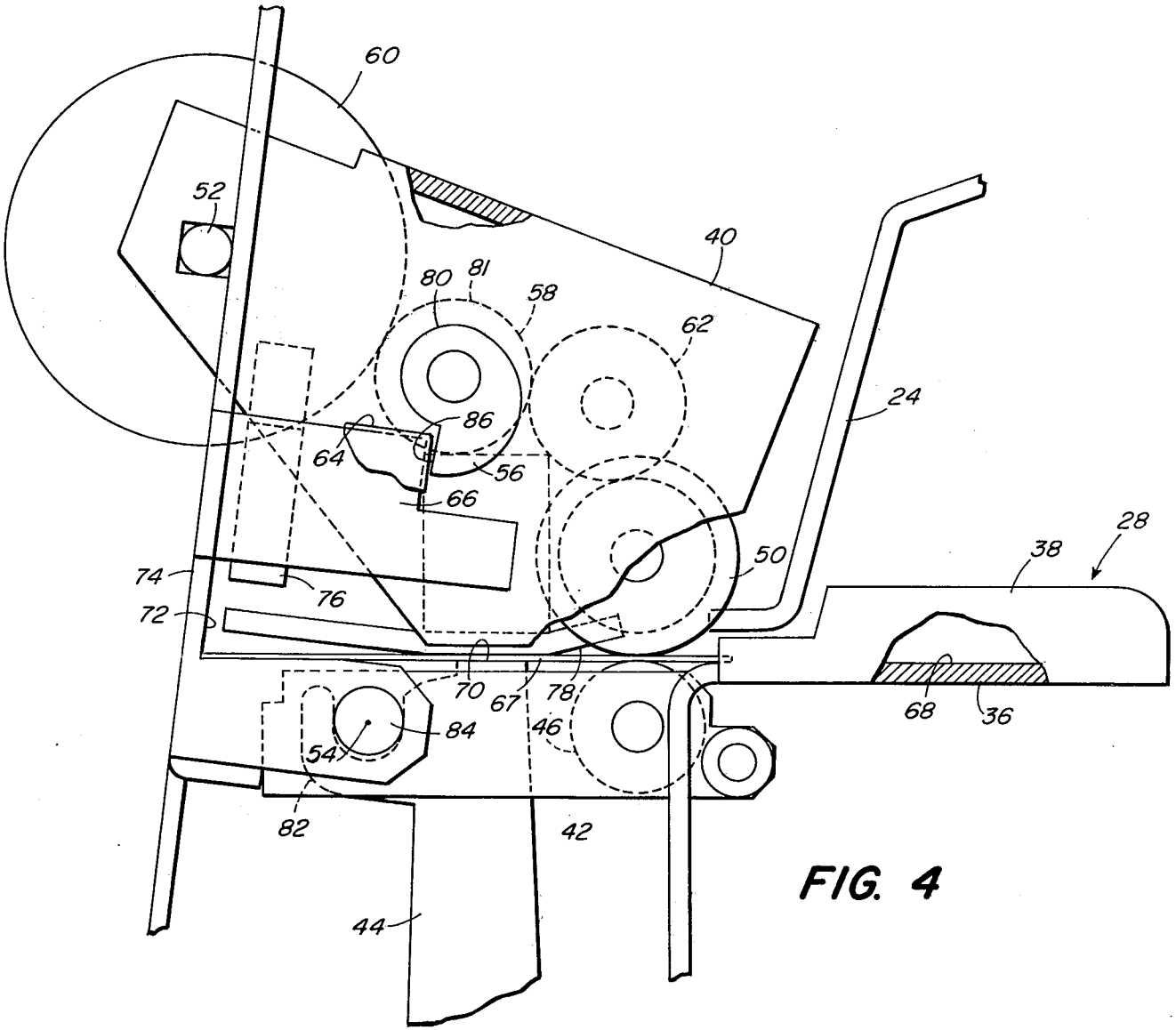
FIG. 4 is a view similar to FIG. 3 of the document printer in a condition suitable for printing a message on a document in place at the printing station.

FIGS. 3 and 4 are essentially enlarged, more detailed views of the broken-away portion of FIG. 2. As mentioned above, during a portion of the cycle of operation of the document printer the frame member 40 is rotated to a position in which the roller 50 and the platen 48 are somewhat removed from, respectively, the roller 46 and the printing head 44. This orientation of the components of the document printer is illustrated in FIG. 3. The orientation with frame 40 rotated toward the frame 42, with rollers 46, 50 engaging a check 67, is illustrated in FIG. 4. But for this change in orientation with respect to each other of the upper and lower movable frames, FIGS. 3 and 4 are identical and the structure depicted therein will be described with reference to both of those figures.

Thus, referring to FIGS. 3 and 4, the upper surface 68 of the horizontal member 36 of tray 28 forms an initial portion of a document feed path into the document printer. That path passes over roll 46, over the uppermost surface 70 of the printing head 44 (which surface is that of an inked ribbon of the printing head), and terminates at a document stop surface 72 of a fixed chassis portion 74. A document sensor 76 (e.g., a photoelectric unit) is also affixed to the member 74 and is directed downward toward the document feed path adjacent the surface 72. The platen 48 is not planar but, rather, includes an upwardly directed from portion 78. This configuration assists in directing a document along the document feed path.

As mentioned above, the upper frame member 40 is biased in a clockwise direction (as viewed in FIGS. 2–4) such that the roller 50 is biased toward contact with the roller 46, but is restrained by cam 56 in certain orientations thereof. A cam surface 80 of cam 56 engages edge 64 of the member 66. Since the cam is supported on the frame 40 for rotation or movement with respect to that frame, rotation of the cam 56 is capable of overcoming the biasing force to move the frame member 40 in a counter-clockwise sense to a position, illustrated in FIG. 3, in which the roller 50 is separated from the roller 46 and the platen 48 is spaced apart from the upper surface 70 of the printing head 44. In a typical situation those separations will be fractions of an inch.

As described in greater detail below with reference to FIGS. 5A-5B, the lower frame member 40 is biased in a counter-clockwise direction about the pivot axis 54 (i.e., roller 46 is biased upward in the view of FIGS. 2–4). As is also described in greater detail with reference to FIGS. 5A–5B, the limits of rotational motion of the frame member 42 are rather precisely defined by stop surfaces, which engage portions of the frame member 42 to define the uppermost and lower most positions of the roller 46. (In FIG. 3, the roller 46 is in its uppermost position. In FIG. 4, the roller 46 is in its lowermost position.)

The impact printing head 44 and associated lateral carriage means (not shown) can be of any conventional design. A suitable printing head is available from Victor Comptometer Corp. under the designation "Model IPM 130". This particular device is a dot matric impact print mechanism in which characters are formed in a two dimensional array of dots. The dots are impact printed with wires driven by print solenoids as the print head moves across the document (i.e., moves in a direction perpendicular to the plane of both FIGS. 3 and 4). Conventional circuitry controls the solenoids such that the wires are driven in a sequence to produce the desired message. To maintain linear alignment of the imprinted characters (i.e., letter or numbers), the printing head includes a hook-shaped member 82 that slidably engages the rod 84 that defines the pivot axis 54 of the lower frame member 42.

Figure 5B:
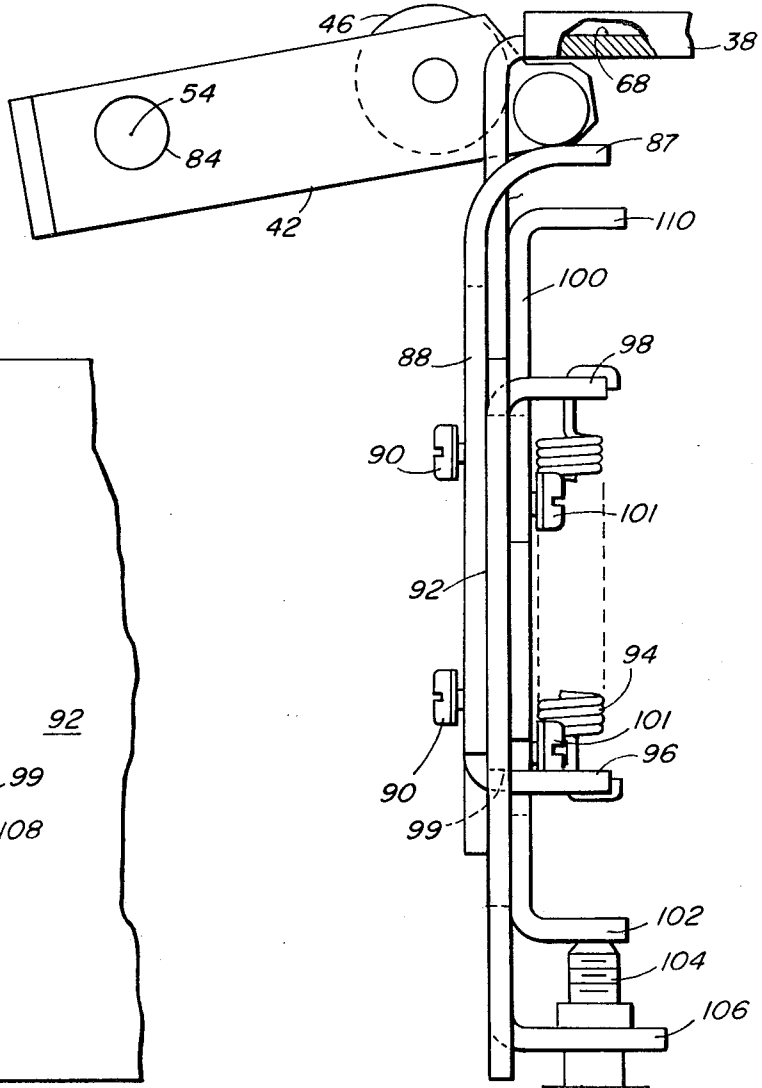
FIGS. 5A and 5B are fragmentary front and side elevations of a biasing and stop-defining system for a movable portion of the document printer illustrated in FIGS. 3 and 4.
Figure 5A:
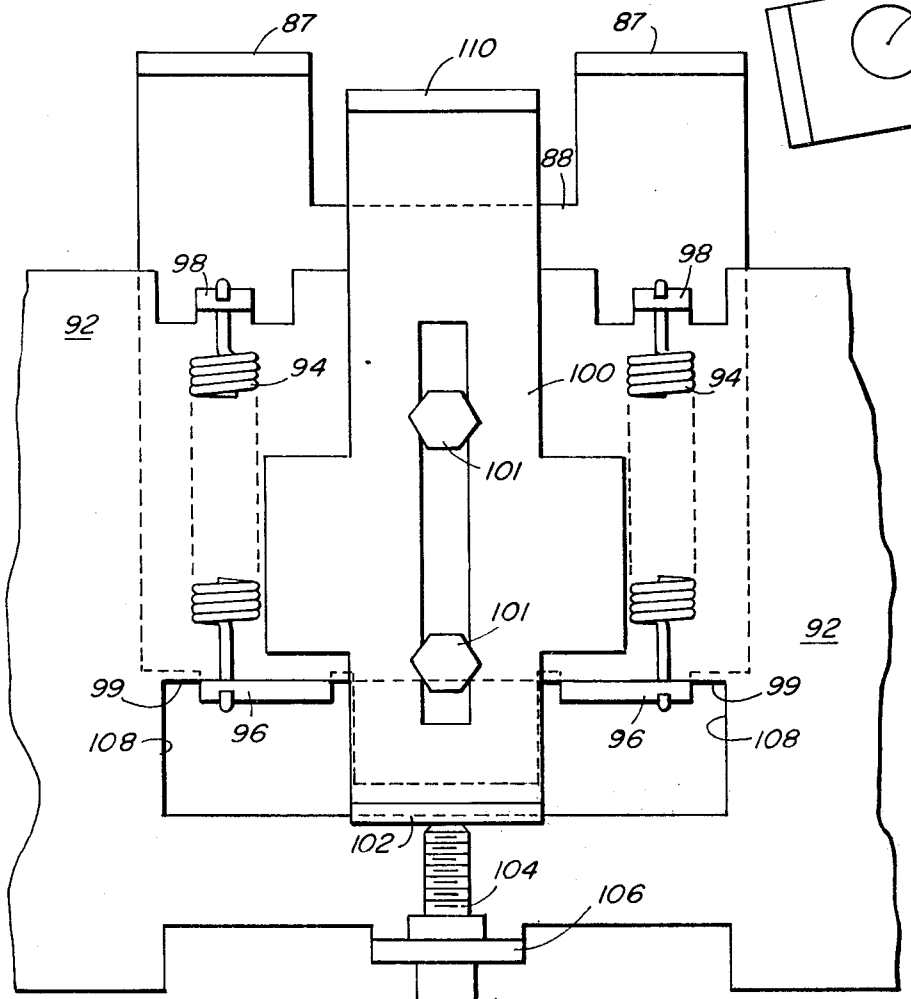

Referring to FIGS. 5A and 5B, the end of lower frame 42 remote from axis 54 rides on upper tabs 87 of a vertically disposed slide 88. The slide 88 is slidably supported by studs 90 on a panel 92 secured to the apparatus chassis. Springs 94 extend between lower tabs 96 of slide 88 and tabs 98 of panel 92 to bias the slide upwardly. The limit of upward motion of slide 88 is determined by the engagement of tabs 96 with upper edge 99 of a window 108 in member 92. An adjustable stop member 100 is slidably secured to the panel 92 by studs 101. A lower tab 102 of the stop member 100 sits on an adjustment screw 104 that is rotatably mounted in a tab portion 106 of panel 92 and that can be employed to move the stop member vertically with respect to the panel 92. An upper tab 110 of the stop member is positioned to engage the frame 42 when slide tabs 87 are even with tab 110. The position of tab 110 thus defines the lower limit of motion of the frame 42.

The operation of the document printer according to the present invention may now be described with reference to the above structural description and the accompanying drawings.

FIG. 3 illustrates the initial state of the document printer prior to the feeding thereto of a document to be printed. This initial state includes the extreme counter-clockwise position of the lower frame member 42, as defined by the stop surfaces 98 shown in FIGS. 5A–5B, and the extreme counter-clockwise position of the upper frame member 40 as forced to that position by the cam 56 against the clockwise biasing force of the upper frame member 40 biasing spring means (not shown). The cam 56 is cut to have its cam surface 80 such that the upper frame 40 can move to a position (as shown in FIG. 3) in which the roller 50 is separated by a substantial gap from the roller 46, even when the lower frame member 42 is its extreme counter-clockwise position. This substantial separation of the rollers 50 and 46 facilitates the feeding of a document therebetween. Furthermore, the counter-clockwise position of lower frame 42 locates the uppermost portions of roller 46 so as to upwardly deflect a document fed along the document path (the initial portions of which are defined by the surface 68 of member 36) so as to avoid entanglement with the ribbon defining the upper surface 70 of the printing head 44.

With the document printer configuration illustrated in FIG. 3, the user inserts a document by placing it on the surface 68 and sliding it toward the left as viewed in FIGS. 3 and 4. The document is deflected upwardly by the roller 46 and is guided by the portion 78 of platen 48 to proceed past the printing head 44. The document eventually engages the surface 72 of chassis member 74 and is prevented from further movement by that surface. Simultaneously, the sensor 76 senses the presence of the document therebeneath and transmits a signal to conventional control circuitry causing activation of a motor that drives gear 60. Gear 60, through engagement with gear 58, initiates the rotation of cam 56 in a counter-clockwise direction as viewed in FIGS. 3 and 4. Shortly thereafter, the radial step 86 in the cam surface 78 passes the edge 64 of member 66, thereby permitting the upper frame member 40 to rotate in a clockwise sense (as viewed in FIGS. 3 and 4) under the influence of its biasing spring (not shown) for a distance equal to the radial extent of the step 86. This radial extent 86 is chosen to cause frame 40 to rotate clockwise through an arc greater than the summation of the distance between rollers 50 and 48 in FIG. 3 and the permitted clockwise rotation of the lower frame member 42. This limitation assures the bottoming of the lower frame member 42 against its lower stop and the engagement of roller 50 with the upper surface of the document positioned between rollers 50 and 46 (see FIG. 4). The same movement of the upper frame member 40 positions the platen 48 closer to the printing head 44 and the intermediate document. With the Victor impact printer mentioned above, the separation of the platen 48 from the printing head will be approximately 0.011 inch plus the thickness of the document. This configuration of the document printer, with the rollers 46 and 50 engaging the opposite surfaces of the document to be printed, is illustrated in FIG. 4.

With the document printer in that configuration, conventional logic circuitry, utilizing input data from the keys 18 (see FIG. 1) controls the operation of the impact printer and the drive train leading to roller 50 to permit the printing of multiple lines of information on the lower surface of the document. The cam member 56 is formed such that a substantial fraction of its circumference is circular with radius less than the radius 81 of gear 58 (see FIG. 3), thereby assuring no movement of the upper frame 40 during the printing sequence. After completion of the printing sequence, the portion of cam surface 80 that spirals outwardly from the circular portion engages the edge 64 of the member 66 to cause a slight counter-clockwise rotation of the upper frame 40 with respect to its pivot axis 52. The upward biasing of the lower frame member 42 causes it to initially follow the counter-clockwise movement of the upper frame 40. The positioning of the stops that define the limits of motion of the lower frame 42, however, cause it to cease its rotational motion before the upper frame 40 is driven to its most counter-clockwise orientation, as shown in FIG. 3. Thus, the continued counter-clockwise of the upper frame member 40 after the cessation of counter-clockwise movement of the lower frame member 42 causes the rollers 50, 46 to separate to an increasing degree until the extreme of FIG. 3 is reached. The separation first reduces, and then eliminates the driving force applied to the document and also frees the document from the nip between the rollers 46 and 50. The result is that the document is deposited in the tray member 36 for convenient removal by the user of the terminal.

As will be apparent to those skilled in the art, at the printing location along the document feed path, the document printing means (i.e., printing head 44 and platen 48) and the document drive means (i.e., rollers 46 and 50) are separated into subunits supported on the separate upper and lower frame members 40 and 42. The arrangements for achieving the slight rotational movements of those frame members thus cooperate to define a relatively large gap between the respective elements of the document printing and driving means (i.e., the gap illustrated in FIG. 3). Those same means, coupled with the thickness of the document itself, cooperate to define a fine gap (i.e., the gap illustrated in FIG. 4), suitable for actual printing.

As mentioned above, the force of the spring biasing the frame 40 downward is chosen to be greater than the upward biasing force on the frame 42 provided by the springs 94. With this arrangement, when the printer is in use with a document being positioned between, and resiliently engaged by, the rollers 46 and 50, the lower frame 42 will always be at its lowermost position as defined by the stop surface 110 (see FIGS. 5A and 5B) and the position of the roller 50 will be such that its lowermost point is spaced from the uppermost point of roller 46 by the thickness of the document 67 (see FIG. 4). The precise positioning of the roller 50, and hence the frame 40 and platen 48, will be determined by the thickness of the document presented to the machine.

As will be appreciated by those skilled in the art, there is an optimum spacing between the uppermost surface of the impact printing means 44 (excluding the ribbon 70) and the opposed lower surface of the platen 48. For the impact printer mentioned above, a suitable gap between the actual printing means (i.e., the solenoid-driven wires) and the platen will be about 0.015 inch, assuming a nominal document thickness of 0.003 inch and a ribbon thickness of 0.004 inch. In this nominal arrangement, the free travel of the impact printing wires will be about 0.008 inch. If no adjustment were made in the print head-to-platen gap, documents having thicknesses greater than the nominal thickness of 0.003 inch would reduce the amount of free travel of the impact printing wires and, indeed, free travel would be entirely lacking if the document were thick enough (e.g., 0.003 inch+0.008 inch=0.011 inch).

By mounting the platen 48 on the same frame (i.e., 40) as the roller 50 and by pivoting that frame about a remote axis 52, the increased document thickness, which will cause a change in the position of the roller 50, will result in an increase of the print head-to-platen gap. With the platen positioned closer to the axis 52 than is the roller 50, the increase in the print head-to-platen gap will be less than the increase in spacing between rollers 46 and 50 and, thus, less than the increased thickness of the document. For example, with an orientation of the parts essentially as shown in the accompanying drawings, a change in the position of roller 50 of 0.015 inch (i.e., a thickness of the document equal to 0.018 inch, rather than the nominal 0.003 inch) the change in the print head-to-platen gap is about 0.010 inch. Since the difference in the movement of the roller 50 and of the platen 48 (i.e., a difference of 0.005 inch) is less than the nominal free travel (i.e., 0.008 inch) of the printing wires, a document of this thickness can be accommodated by the printing head. Such a thicker document could not be accommodated absent the self-compensation of the print head-to-platen gap with changes in document thickness. (For any particular geometrical arrangement of axis 52, platen 48, and roller 50, one skilled in the art can, through geometrical analysis, determine the amount of print head-to-platen gap increase for a given increase in separation of the rollers 46 and 50.)

While a particular preferred embodiment of the present invention has been illustrated in the accompanying drawings and described in detail herein, other embodiments are within the scope of the invention and the following claims.

I claim:

1. Apparatus for printing a message on a document comprising a document feed path defined with respect to a rigid chassis, a printing station along said path, said printing station including impact printing means and document drive means, each of said printing means and drive means comprising first and second subunits positioned, respectively, below and above said document feed path;

first and second frames supported in said chassis, said first subunits supported on said first frame and said second subunits supported on said second frame, said first frame supported to position said first subunits below said document feed path, and, said second frame being movable between a first position in which said drive means subunit supported thereon is spaced apart from a document positioned on said feed path and a second position in which that drive means subunit engages a document positioned on said feed path and also in which said impact printing means subunits are located with respect to each other so as to enable printing a message on said document;

a drive system for moving said second frame to its second position when a document is properly located for printing and for moving said second frame to its first position after printing of the document has been completed, wherein said first and second subunits of said drive means comprise first and second rollers, said apparatus further including means for driving one of said rollers, wherein said second frame is supported on said chassis for rotational movement between said first and second positions about an axis of rotation that is parallel to the axes of said rollers; said drive system including second frame biasing means for biasing said second frame toward its first position, wherein said first frame is supported on said chassis for limited rotational motion with respect to said chassis about an axis of rotation parallel to the axes of said rollers, said apparatus further including first frame biasing means urging said first frame in a direction such that said first roller is urged toward contact with said second roller, said apparatus further including first and second stop means engagable with said first frame, said first stop means defining the limit of travel of said first roller toward said second roller such that said first roller will intercept a document proceeding along said document feed path whereby said document will avoid interferring contact with the uppermost portions of said printing means subunit supported on said first frame, said first frame biasing means having less biasing force than the biasing means for said second frame, whereby movement of said second frame to its second position forces said first frame to engage said second stop means.

2. Apparatus for printing a message on a document comprising a document feed path defined with respect to a rigid chassis, a printing station along said path, said printing station including impact printing means and document drive means, each of said printing means and drive means comprising first and second subunits positioned, respectively, below and above said document feed path;

first and second frames supported in said chassis, said first subunits supported on said first frame and said second subunits supported on said second frame, said first frame supported to position said first subunits below said document feed path, and, said second frame being movable between a first position in which said drive means subunit supported thereon is spaced apart from a document positioned on said feed path and a second position in which that drive means subunit engages a document positioned on said feed path and also in which said impact printing means subunits are located with respect to each other so as to enable printing a message on said document;

a drive system for moving said second frame to its second position when a document is properly located for printing and for moving said second frame to its first position after printing of the document has been completed, wherein said document feed path includes an entrance aperture for insertion of a document to said printing station and a stop surface on the other side of said printing station from said entrance aperture, said stop surface defining the position of a document with respect to said printing station prior to printing; and wherein said drive means are operative to drive a document in a direction along said path toward said entrance aperture; whereby a document presented to said apparatus through said entrance aperture is returned to the user of the machine, after the printing operation, at the same location that the document was fed to the apparatus.

* * * * *